US009914508B2

(12) United States Patent
Neese

(10) Patent No.: US 9,914,508 B2
(45) Date of Patent: Mar. 13, 2018

(54) STOWABLE FOLDING BOAT STEP

(71) Applicant: Grady-White Boats, Inc., Greenville, NC (US)

(72) Inventor: David A. Neese, Greenville, NC (US)

( * ) Notice: Subject to any disclaimer, the term of this patent is extended or adjusted under 35 U.S.C. 154(b) by 0 days.

(21) Appl. No.: 15/291,296

(22) Filed: Oct. 12, 2016

(65) Prior Publication Data

US 2017/0106949 A1 Apr. 20, 2017

Related U.S. Application Data

(60) Provisional application No. 62/242,653, filed on Oct. 16, 2015.

(51) Int. Cl.
*B63B 17/00* (2006.01)
*B63B 29/04* (2006.01)

(52) U.S. Cl.
CPC ..... *B63B 29/04* (2013.01); *B63B 2029/043* (2013.01)

(58) Field of Classification Search
CPC ... B63B 27/14; B63B 27/146; B63B 2027/14; B63B 2027/146; B63B 2029/043
USPC ..... 114/362, 363, 364
See application file for complete search history.

(56) References Cited

U.S. PATENT DOCUMENTS

| | | | | | |
|---|---|---|---|---|---|
| 119,050 | A | | 9/1871 | Rickel | |
| 590,155 | A | | 9/1897 | Leathers | |
| 601,118 | A | | 3/1898 | Beatty | |
| 624,115 | A | | 5/1899 | Steele | |
| 945,208 | A | | 1/1910 | Arter | |
| 970,777 | A | | 9/1910 | Ackerman | |
| 1,005,080 | A | | 2/1911 | Storm | |
| 1,059,467 | A | | 4/1913 | Hoy | |
| 1,102,480 | A | | 7/1914 | Davis | |
| 1,118,584 | A | | 11/1914 | Roebuck | |
| 1,984,602 | A | | 7/1931 | Snyder | |
| 1,842,954 | A | | 1/1932 | Anderson | |
| 2,197,266 | A | | 4/1939 | Fredell | |
| 2,809,849 | A | | 10/1957 | Benne | |
| 3,195,680 | A | * | 7/1965 | Thornburg | B63B 27/14 114/362 |
| 3,794,140 | A | * | 2/1974 | Sell | B63B 27/14 114/362 |
| 4,030,436 | A | | 6/1977 | Stoberl | |
| 4,068,601 | A | | 1/1978 | Marsh et al. | |
| 4,124,910 | A | * | 11/1978 | Raymond | B63B 7/06 114/354 |
| 4,432,436 | A | * | 2/1984 | Suiter | B63B 27/14 114/343 |
| 4,632,457 | A | | 12/1986 | Hofrichter et al. | |
| 4,733,752 | A | * | 3/1988 | Sklar | B60R 3/02 182/157 |
| 4,889,057 | A | | 12/1989 | Chartrand | |
| 4,926,965 | A | * | 5/1990 | Fox | B63B 27/14 114/362 |

(Continued)

*Primary Examiner* — Daniel V Venne
(74) *Attorney, Agent, or Firm* — Olive & Olive, P.A.

(57) ABSTRACT

A folding step for a boat cockpit includes a gunwale bracket connectable to a wall extending downward from a gunwale of a boat. Support bracket(s) support a step in a pivoting manner between a deployed and a stowed position. A support bar is attachable within the cockpit to be in a stowed position, in which it is out of the way, and in a deployed position for supporting the step when it is deployed.

19 Claims, 20 Drawing Sheets

(56) References Cited

U.S. PATENT DOCUMENTS

| | | | | | |
|---|---|---|---|---|---|
| 5,152,244 | A | * | 10/1992 | Jarmillo, Jr. | B63B 27/14 114/362 |
| 5,185,892 | A | | 2/1993 | Mitchell | |
| 5,427,049 | A | * | 6/1995 | Mardikian | B63B 27/14 114/274 |
| 5,458,080 | A | * | 10/1995 | Jaramillo, Sr. | B63B 27/14 114/362 |
| 5,927,433 | A | * | 7/1999 | Jaramillo, Sr. | B63B 27/14 114/343 |
| 5,970,905 | A | * | 10/1999 | Jaramillo, Sr. | B63B 27/146 114/362 |
| 6,305,741 | B1 | | 10/2001 | Fernandez | |
| 6,789,494 | B2 | | 9/2004 | Neese et al. | |
| 6,904,863 | B2 | * | 6/2005 | Mardikian | B63B 27/146 114/362 |
| 9,505,467 | B2 | * | 11/2016 | Canaris | B63B 27/146 |

* cited by examiner

STOWABLE FOLDING BOAT STEP

CROSS-REFERENCE TO RELATED APPLICATION

This application is related to and claims priority to provisional application Ser. No. 62/242,653 filed Oct. 16, 2015 of the same inventors herein entitled STOWABLE FOLDING BOAT STEP. The disclosure of Provisional Application Ser. No. 62/242,653 is expressly incorporated herein by reference in its entirety.

BACKGROUND OF THE INVENTION

1. Field of the Invention

This invention relates to a foldable and stowable boat step for use in the cockpit of a boat, for example, to facilitate boarding and unboarding. More specifically, the invention relates to a foldable boat step which can be deployed from a stowed position for stepping into and out of a boat, and when not in use can be stowed unobtrusively in a stowage area within the boat cockpit, for example, beneath the gunwale of a boat.

2. Discussion of Art

Boarding and unboarding of boats can often be a difficult task, particularly for people who are more advanced in age. Thus, it is desirable to provide a step for use in boarding and unboarding a boat which is unobtrusive and stowable, and also stable when deployed.

Current attempts to provide steps for boarding and unboarding of boats include ladder-like structures which abut against, for example, the gunwale of a boat. However, these structures are often unstable and do not stow away easily, thereby occupying valuable space within the cockpit of a boat.

Other attempts to provide steps to assist in boarding and unboarding a boat include single boarding steps that can be deployed both outside and inside a boat. Often when using such steps, two steps need to be deployed, one for boarding the boat from a dock and one for assisting in stepping into the boat cockpit and vice versa.

Other attempts to assist in boarding and unboarding a boat include molded fold-out steps, which fold into an inner side wall of a cockpit. It is also known to provide a folding step that mounts on the wall of a cockpit or outside of the boat, which folds into an upward position to be stored away on the boat structure. Such steps are available commercially, for example, from Perko, Inc. Similarly, fixed step plates can also be used of the type which are also mounted on the boat, but in all cases, because it is fixed the step projects from the cockpit wall into the cockpit thereby creating a tripping hazard. Such steps are also of a size, which is insufficient to provide a stable footing for entering and exiting the cockpit of a boat because they are too small in relation to an average user's feet.

All of these attempts to provide boat steps are cumbersome and/or unstable and often result in cockpit space being taken up and wasted. In addition, the use of such fixed steps also result in a lack of ability to safely stow the step out of the way. Thus, in accordance with the invention, the problems of the prior art are overcome with a folding step for a boat, and a boat step system according to the invention which is easily deployed and stowed, as is more fully described hereafter.

SUMMARY OF THE INVENTION

In one aspect there is provided a folding step for a boat cockpit. The folding step includes at least one gunwale bracket connectable to a wall extending downward from a gunwale of a boat and within a boat cockpit. At least one step support bracket is connected to the at least one gunwale bracket in pivoting relationship thereto for supporting a step in a deployed position and in a stowed position. A step is mounted on the at least one step support bracket, which has an upper step surface. A support bar is also provided which is pivotally mountable in a stowage area of a boat cockpit, beneath, for example, the gunwale for pivoting in an outward direction to abut against a bottom of the step and brace the bottom of the step to support the step in a deployed position and for pivoting into a vertical position to allow the step to pivot into a vertically extending stowed position for being stowed in a stowage area of a boat cockpit. The invention also relates to a step system on a boat including the above described folding step.

BRIEF DESCRIPTION OF THE DRAWINGS

Having thus briefly described the invention, the same will become better understood from the appended drawings viewed with reference to the detailed description, in which.

DETAILED DISCUSSION OF EXEMPLARY EMBODIMENTS

Figure 1:
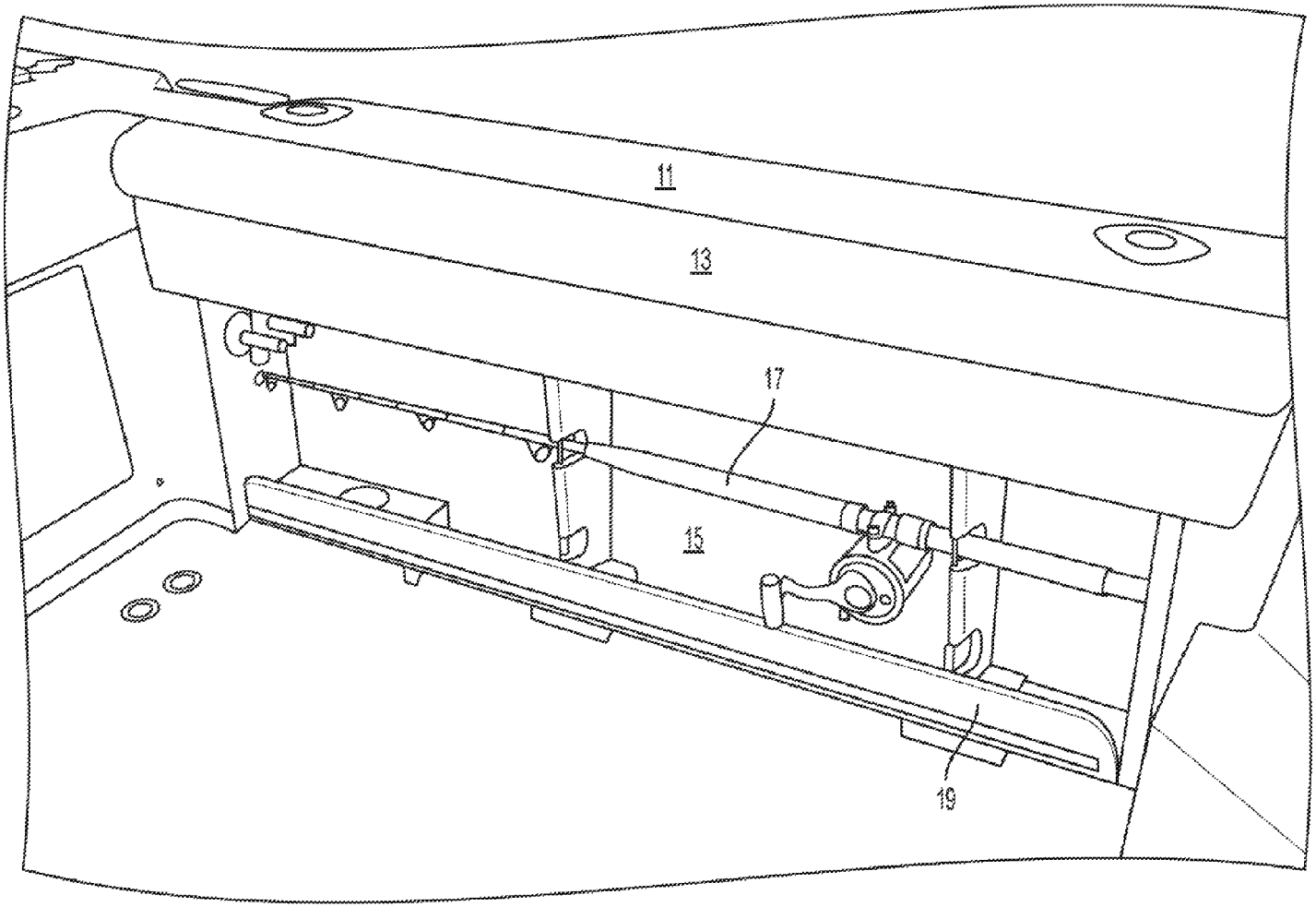
FIG. 1 is a perspective view of a conventional interior of a boat and/or boat cockpit, showing a gunwale and a stowage area for fishing rods underneath the gunwale.
Figure 2:
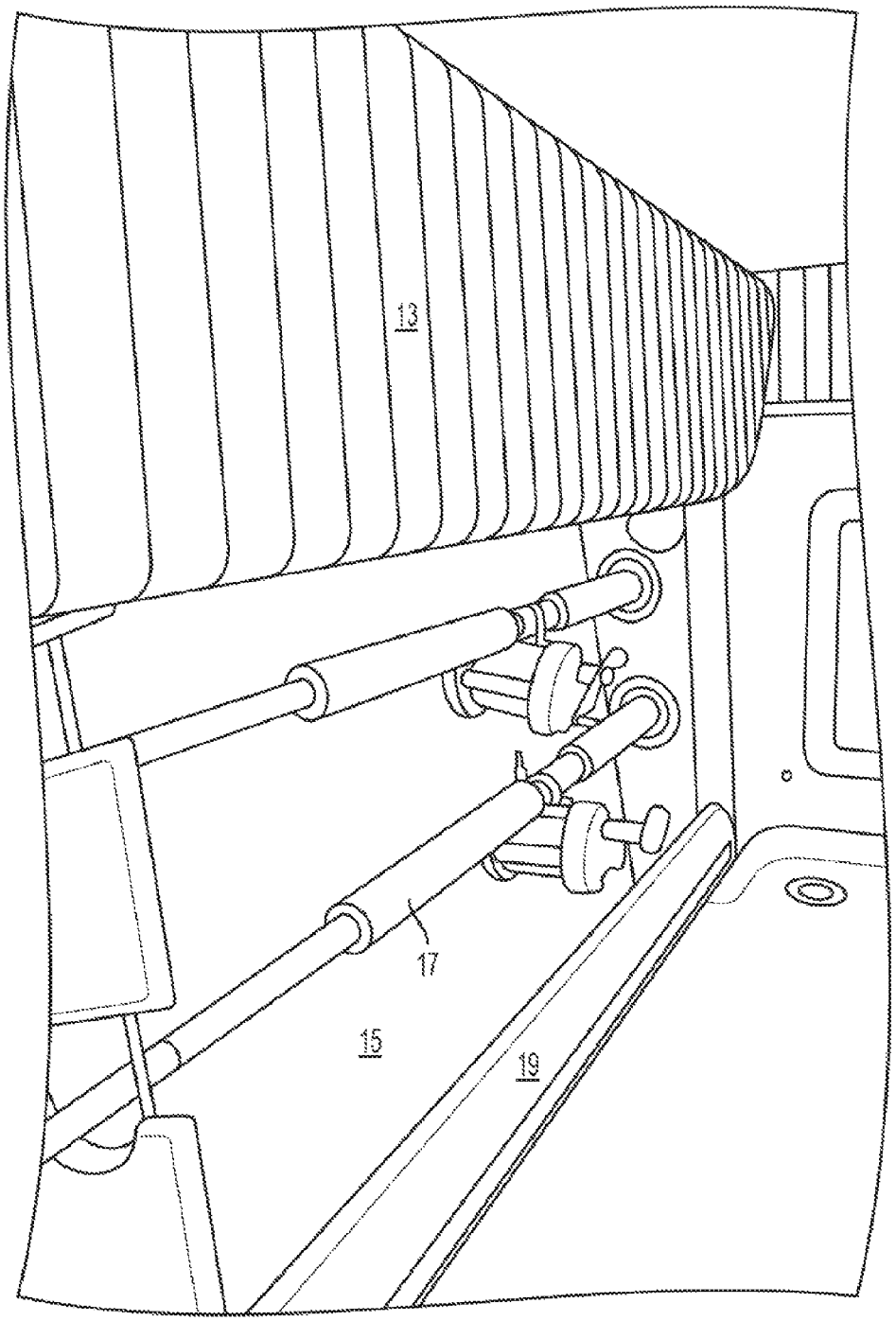
FIG. 2 is a second perspective view similar to that of FIG. 1 showing a stowage area in a cockpit of a boat, and also showing fishing rods stored within the stowage area.

FIG. 1 illustrates in perspective view an exemplary conventional interior of a boat showing a stowage area 15 underneath a gunwale 11, with a bolster 13 attached on a downwardly extending partial wall, for storage of fishing rods 17. Such an arrangement is conventional and well known to those of ordinary skill. The stowage area 15 is also bounded at the bottom by a toe rail 19, which is also of the type well-known to those of ordinary skill in the art. FIG. 2 is another perspective view of the stowage area 15 in the cockpit of a boat showing the bolster 13, and fishing rods 17 stowed supported on hooks (not numbered) therein, also shown is the toe rail 19. As will be appreciated, while the invention can be deployed for use with other types of stowage areas, a typical environment in which such a step may be stowed is the stowage area 15 generally depicted, such as is found on many boats.

Figure 3B:
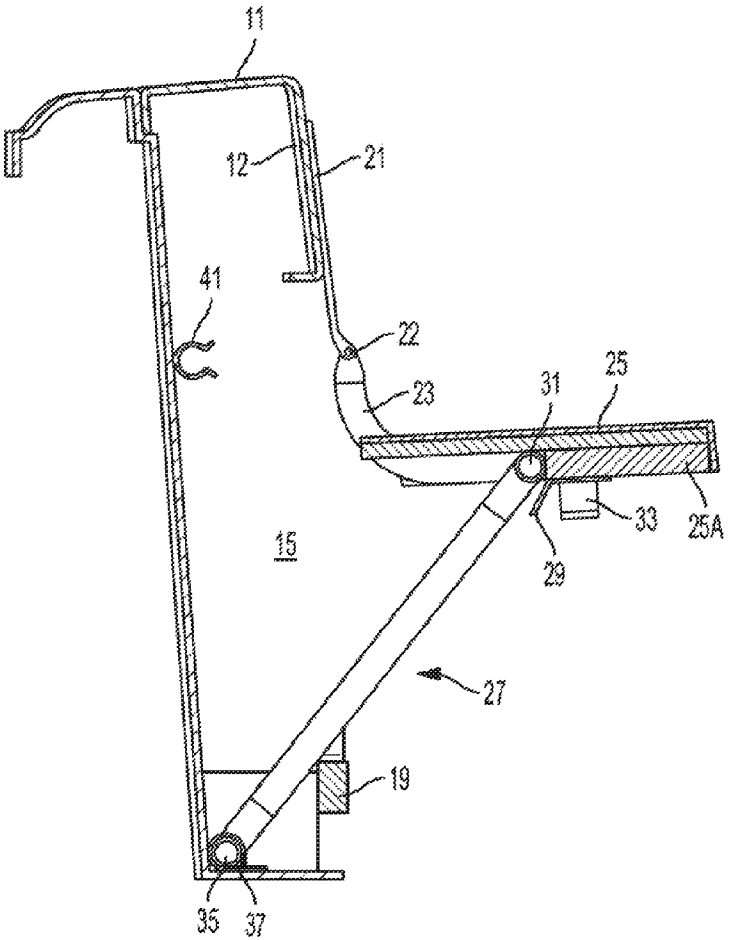
FIGS. 3*a* and 3*b* are perspective and side partial cross-sectional views respectively, of a folding step in accordance with the invention mounted in a boat cockpit with the step shown in a deployed position.
Figure 3A:
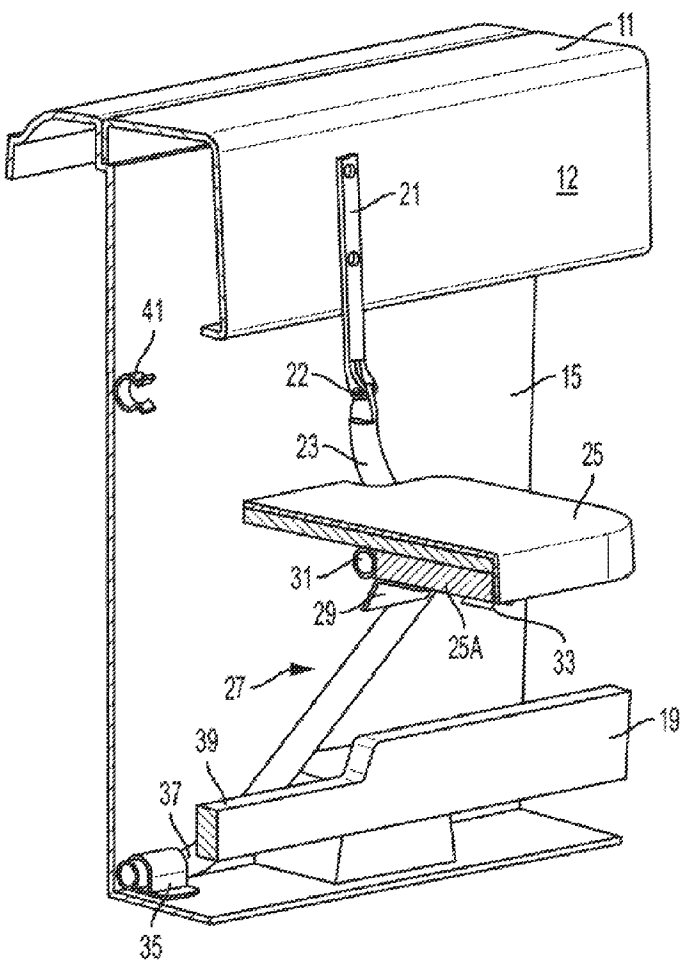

FIGS. 3*a* and 3*b* illustrate respectively in partial cross-section perspective and side-views an embodiment of a boat step 25, which is foldable and stowable in accordance with the invention. When deployed on a boat, at least one gunwale bracket 21 is preferably secured to a wall 12 extending from the gunwale 11 of a boat. Typically, that wall 12 is a partial wall and terminates at a point located below the gunwale 11, and partly defines a stowage area 15 behind and below the wall 12 for stowage of fishing rods 17 and other paraphernalia.

Each gunwale bracket 21 may be secured to the wall 12 extending from the gunwale 11 and each gunwale bracket 21 may be connected to a step support bracket 23 which is partially curved but generally extends in a horizontal direction as shown. The step support bracket 23 is connected at a pivot connection 22 to the gunwale bracket 21. The step support bracket 23 supports a step 25 having a thicker portion 25*a* relative to the rest of the step 25 towards the front thereof, and having an abutment flange 29 against which is braced a pivoting support bar 27 to support the step 25 when in the deployed position. In a preferred embodiment as shown, there are two gunwale brackets 21 and two step support brackets 23. The toe rail 19 is shown having a cutout region 39 to provide a clearance for support bars 26.

Figure 4:
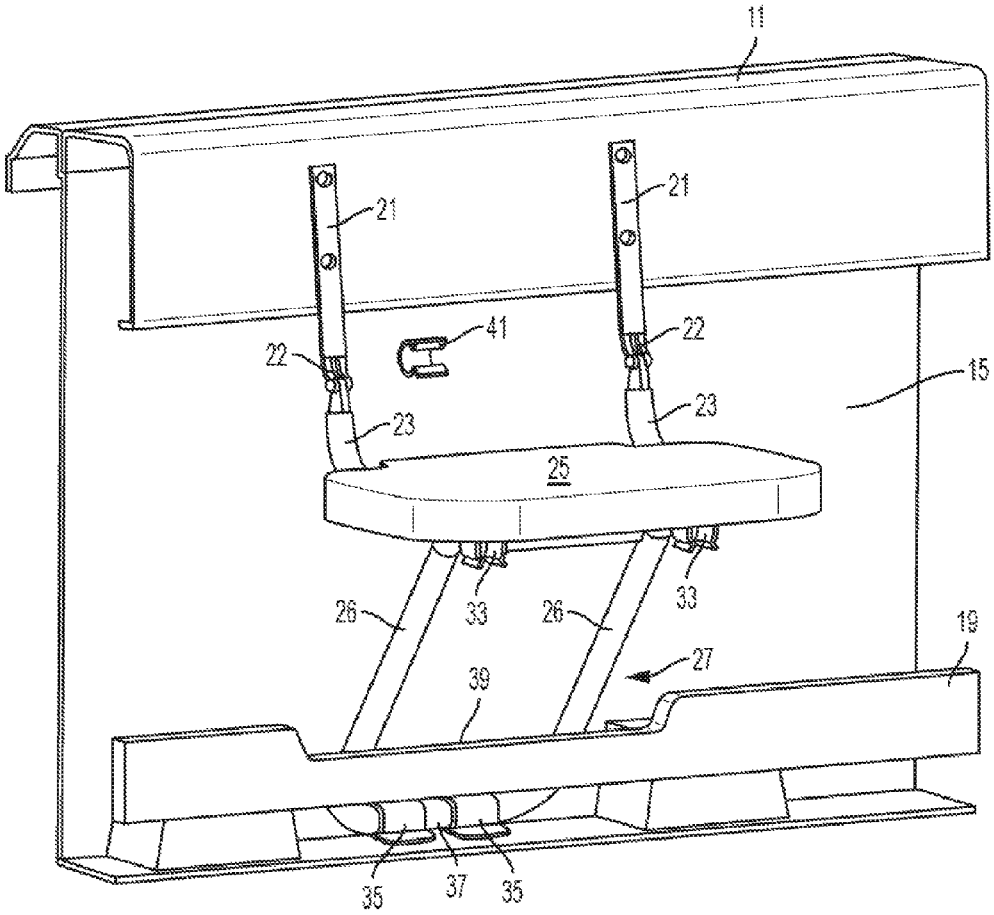
FIG. 4 is a perspective view of the folding step in accordance with the invention shown in a deployed position.

As shown in FIG. 4, the support bar 27 may be of a general o-shape, and is held in a pivoting manner within the stowage area 15 by mounting clips 35, as shown in FIGS. 3*a*, 3*b* and 4. The mounting clips 35 extend around a horizontal section 37 making up the bottom of support bar 27. An upper horizontal section 31 of the support bar 27 makes up part of the "o" shape of support bar 27, and also extends at the top of the support bar 27 to bear against the abutment flange 29 on the bottom of the step 25. The support bar 27 also includes two vertically extending sections 26, each connected respectively to horizontal sections 31 and 37 to form the generally "o" shape. As discussed with reference to FIGS. 3*a*, 3*b*, and 4, the gunwale brackets 21 preferably comprise a pair of brackets 21, generally parallel to each other, as do the step support brackets 23, which are also parallel to each other to support the step 25 by being connected to the underside thereof proximate or adjacent the outside edges of the step 25. Also provided is a step support bar clip 41 and step clips 33. The support bar clip 41 is mountable/mounted on a wall of the boat cockpit within the stowage area. The step clips 33 extend from a bottom surface of step 25, and their function will be more clearly explained hereafter with reference to FIGS. 5*a*, 5*b*, 6, and 7. As previously discussed, the toe rail 19 may have a cutout notch 39 to allow for proper positioning of support bar 27 by providing space for the support bar 27 when the step 25 and support bar 27 are deployed.

Figure 5B:
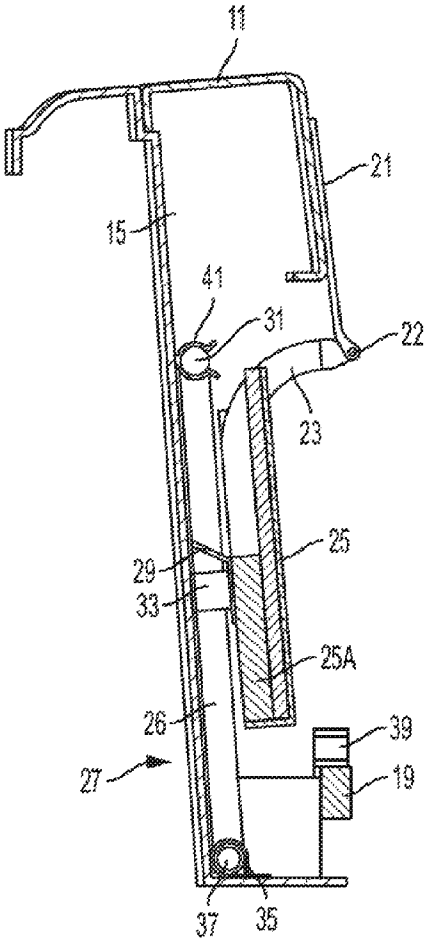
FIGS. 5*a* and 5*b* are perspective and side partial cross-sectional views respectively of the folding step in accordance with the invention, shown in a stowed position in a stowage area of a boat.
Figure 5A:
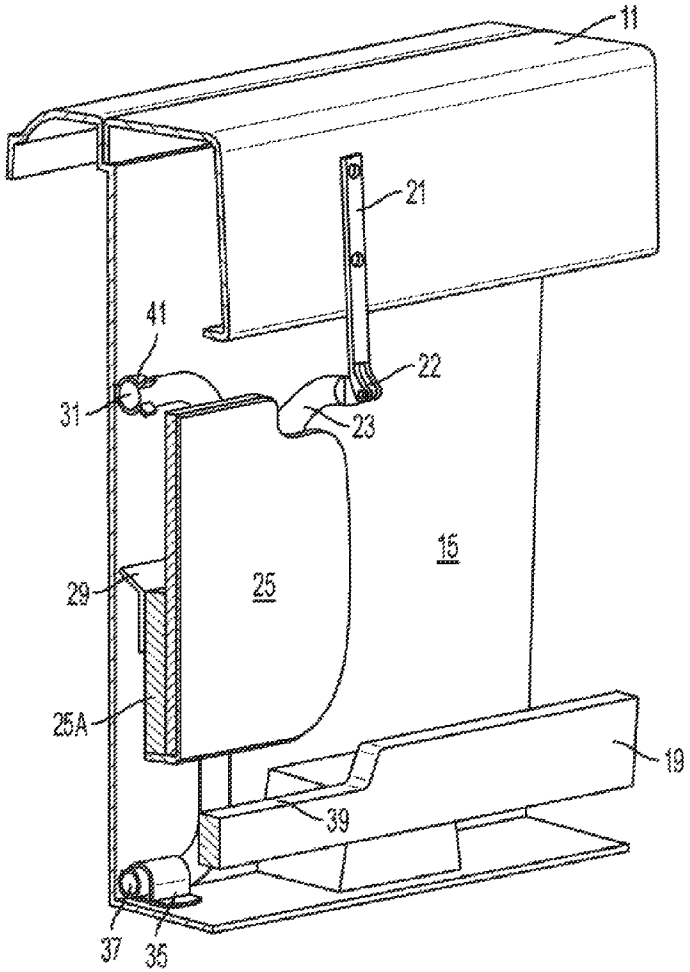
Figure 6:
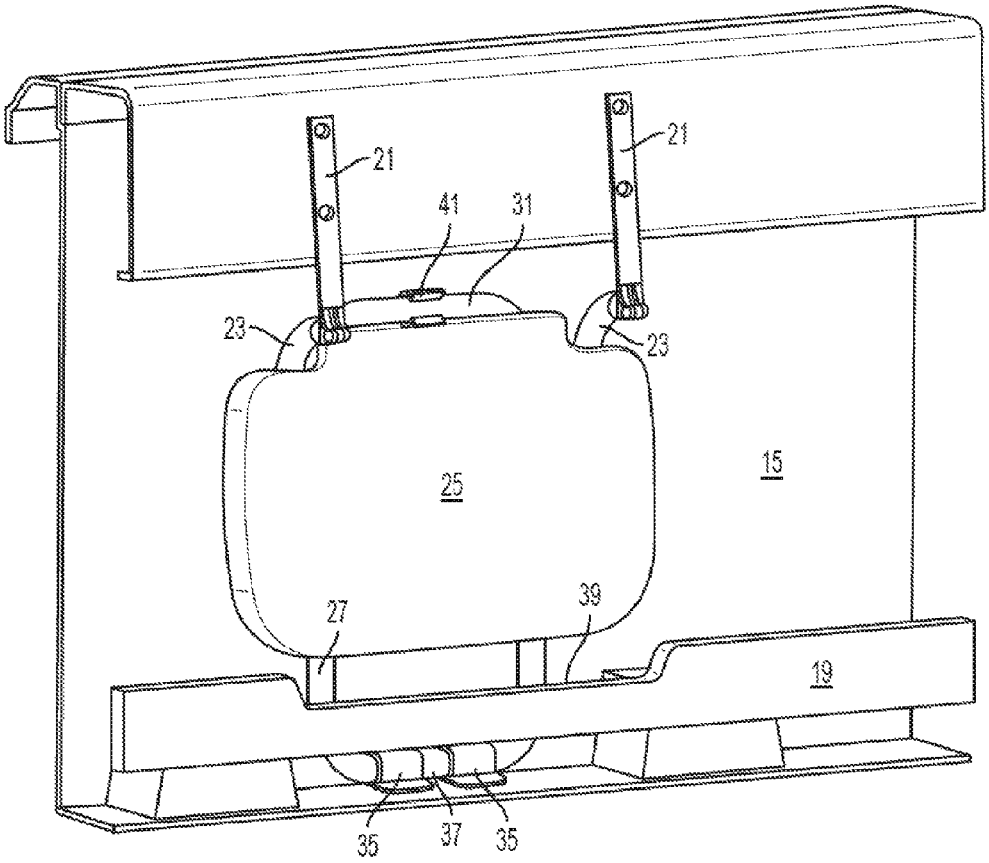
FIG. 6 is a perspective view of the folding step in accordance with the invention shown in a stowed position in a stowage area.

FIGS. 5*a*, 5*b*, and 6 show the step assembly of the invention in a stowed position within stowage area 15. As shown therein, the support bar 27 is pivoted into a vertically extending position within the stowage area 15 and secured therein at the upper horizontal section 31 thereof by support bar clip 41. The support bar clip 41 is attached to a wall of stowage area 15. As seen in greater detail in FIG. 5*b*, step clips 33, which extend from the bottom of the step 25, clip onto respective vertically extending (when step is stowed) portions 26 of support bar 27 to ensure that the step 25 is held securely within the stowage area 15.

Figure 7:
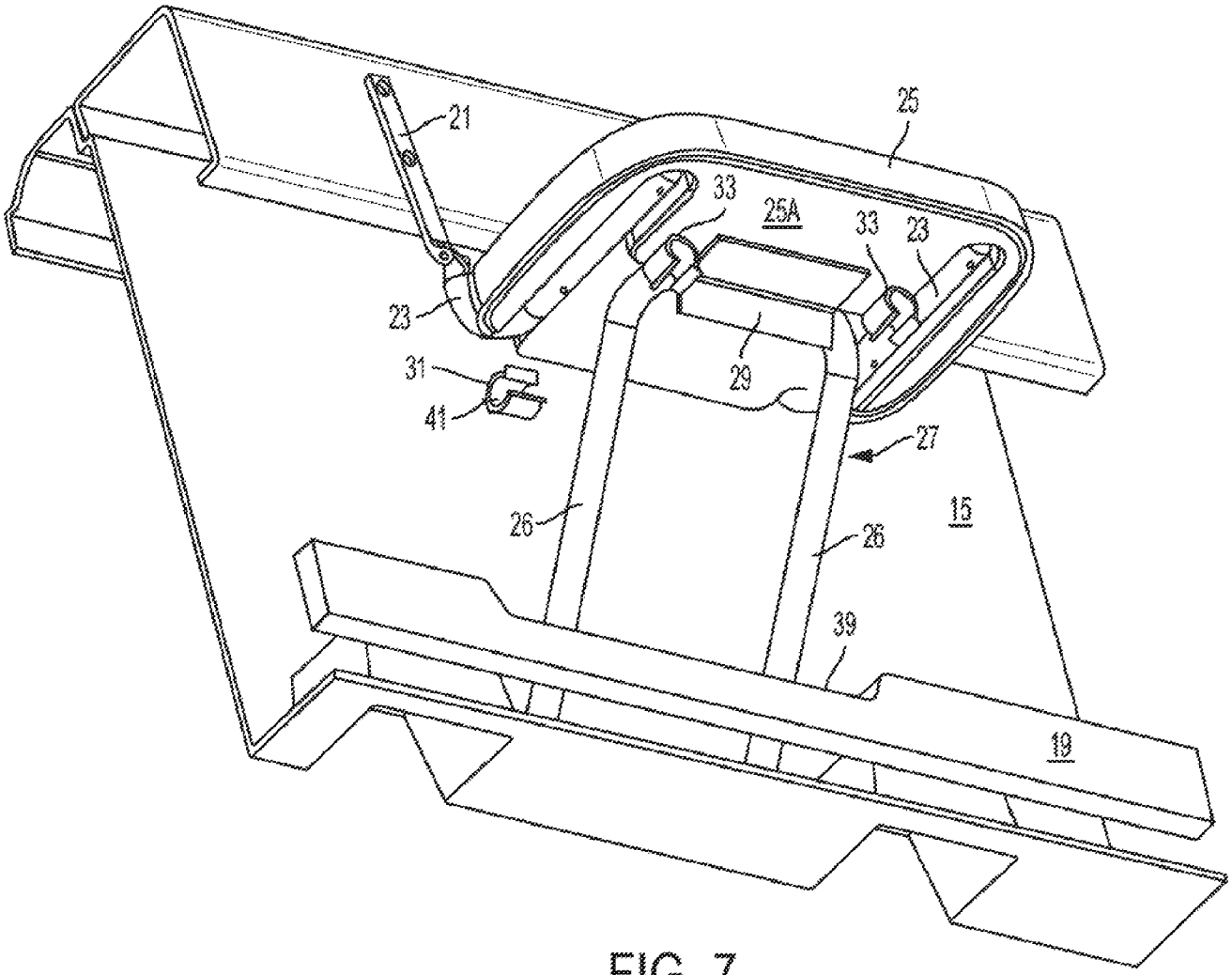
FIG. 7 is a perspective view, from below the step in accordance with the invention, showing the step in a deployed position.

As is more clearly shown in FIG. 7, step clips 33 of the step 25 are aligned with the vertically extending sections 26 of support bar 27, so that when the step 25 is folded into the stowage area 15, the step clips 33 clip onto sections 26 of the support bar 27, and the support bar 27 section 31 clips onto support bar clip 41 to be held securely in a stowed position.

Figure 8:
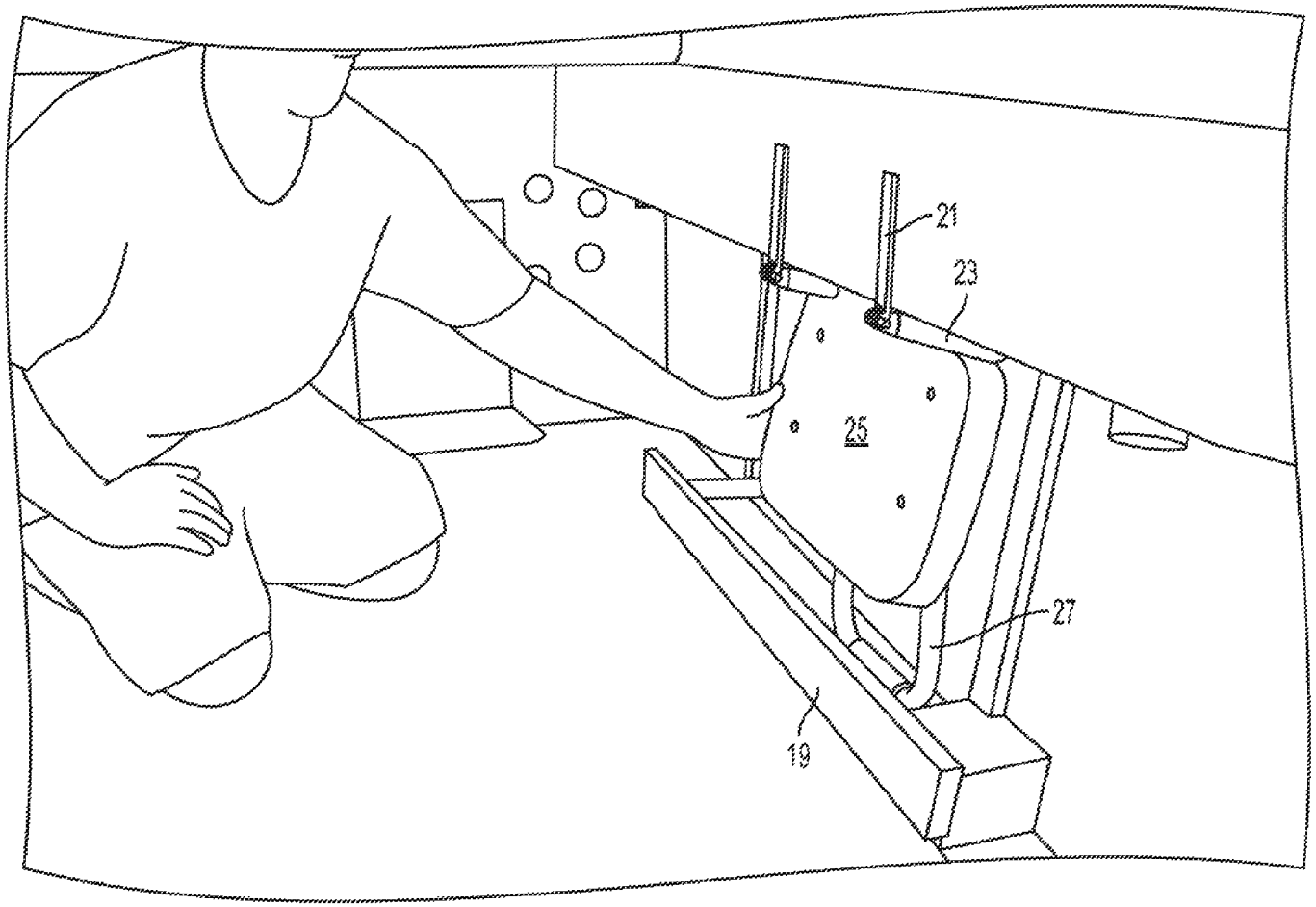
FIG. 8 is a perspective view of the step of the invention shown in stowed position in a first position about to be deployed.
Figure 9:
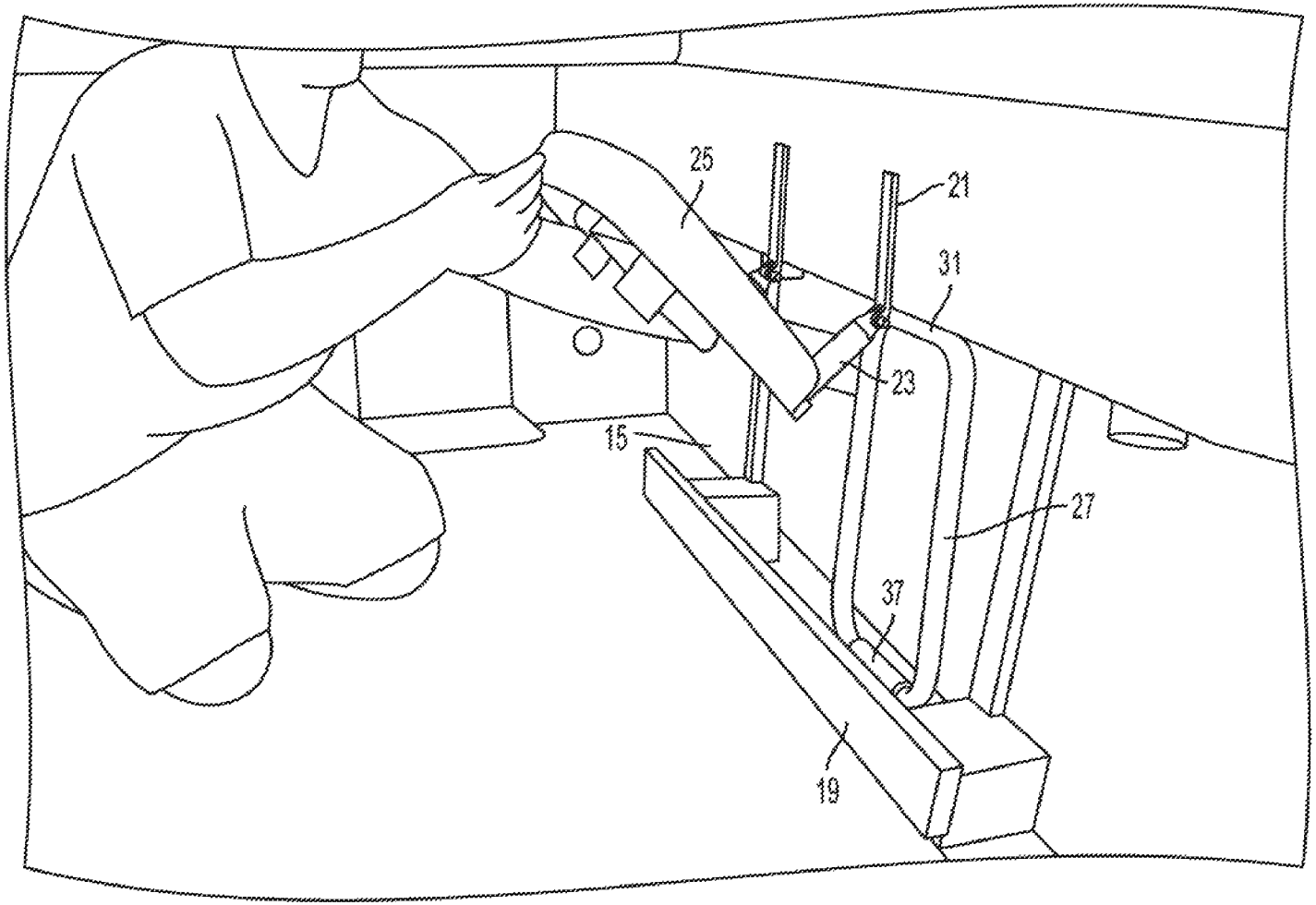
FIG. 9 is a perspective view as in FIG. 8 showing the position of the step in its a second position during deployment thereof.
Figure 10:
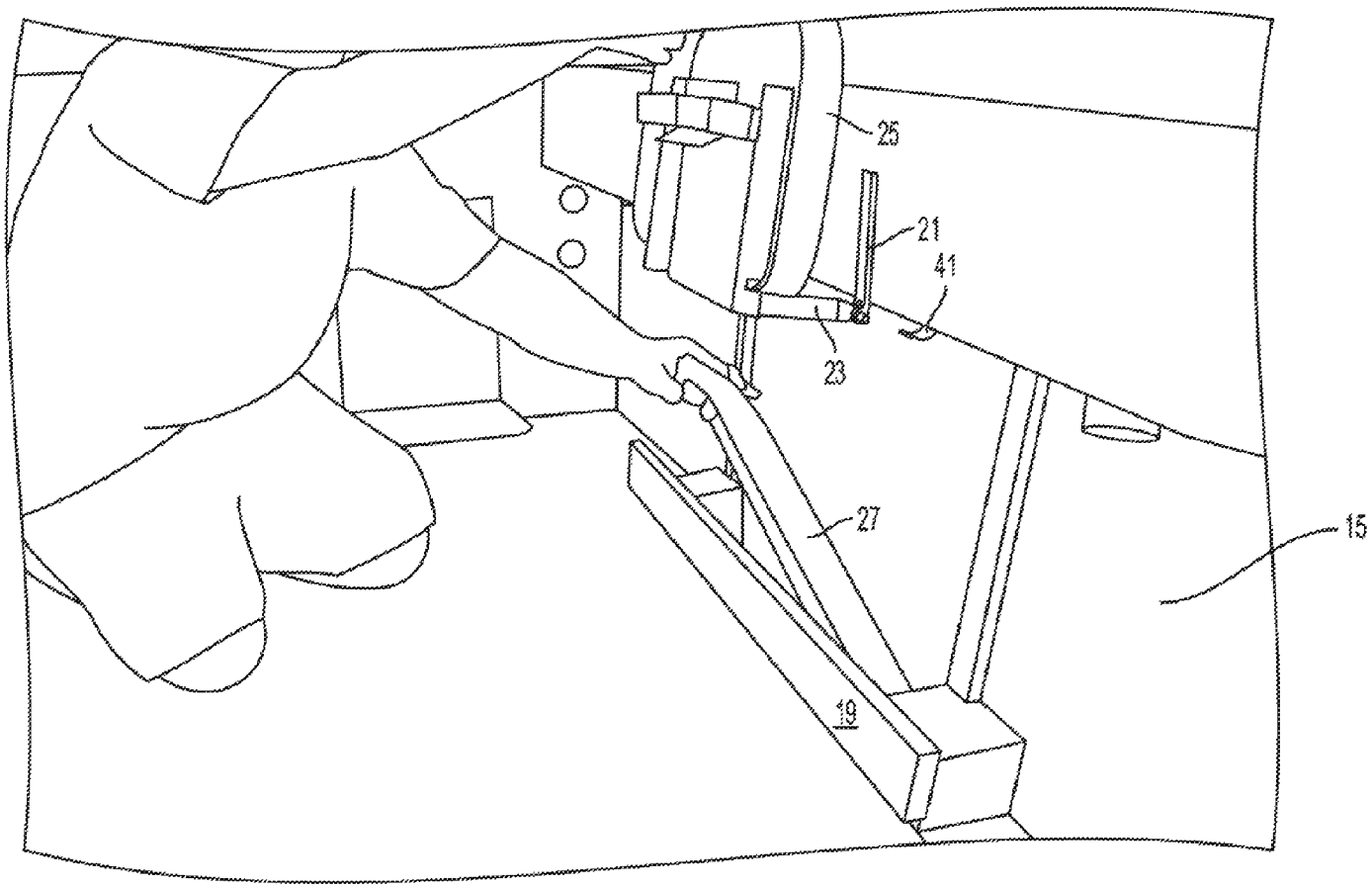
FIG. 10 is a perspective view as in FIGS. 8 and 9 showing the step in a third position moved out of the way to allow deployment of a support bar for supporting the step.

Turning now to FIGS. 8-16, the operation of the folding step in accordance with the invention is illustrated. In the embodiment shown in FIGS. 8-16, the step support bracket 23 is generally L-shaped with right angle connection structure pivotally connected to the gunwale bracket 21. In addition, in this embodiment the toe rail 19 does not include a toe rail cutout notch 39 as was shown in a prior embodiment. In FIG. 8, the step 25 is shown about to be deployed by a user. FIG. 9 then illustrates a user pulling the step 25 upwardly and away from the stowage area 15 to allow the support bar 27 to be deployed. FIG. 10 illustrates how the support bar 27 is unclipped from support bar clip 41 and allowed to pivot outwardly into a support position.

Figure 11:
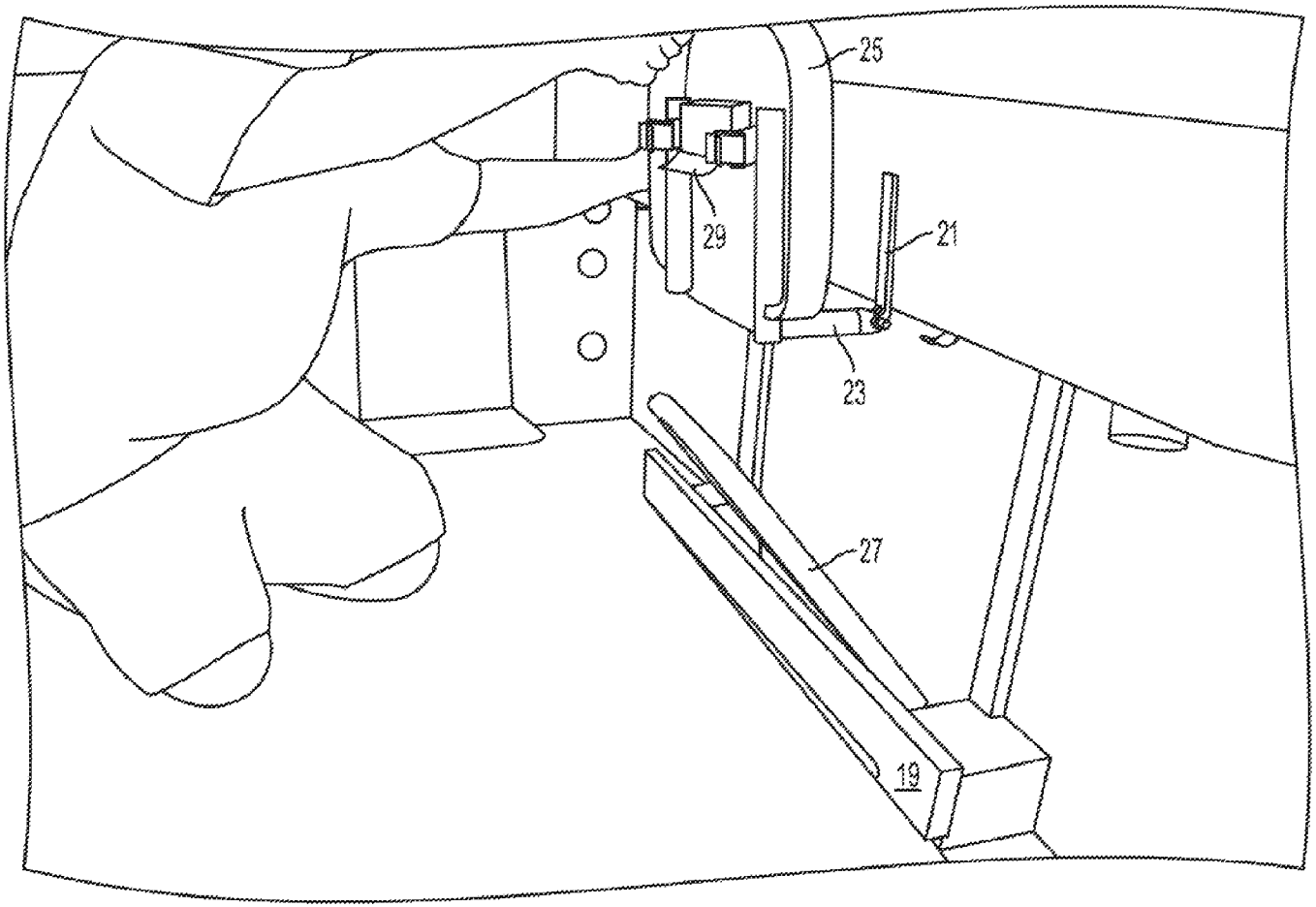
FIG. 11 is a perspective view as in FIGS. 8, 9 and 10 showing the support bar in fully deployed position for supporting the step when it is lowered onto the support bar.
Figure 12:
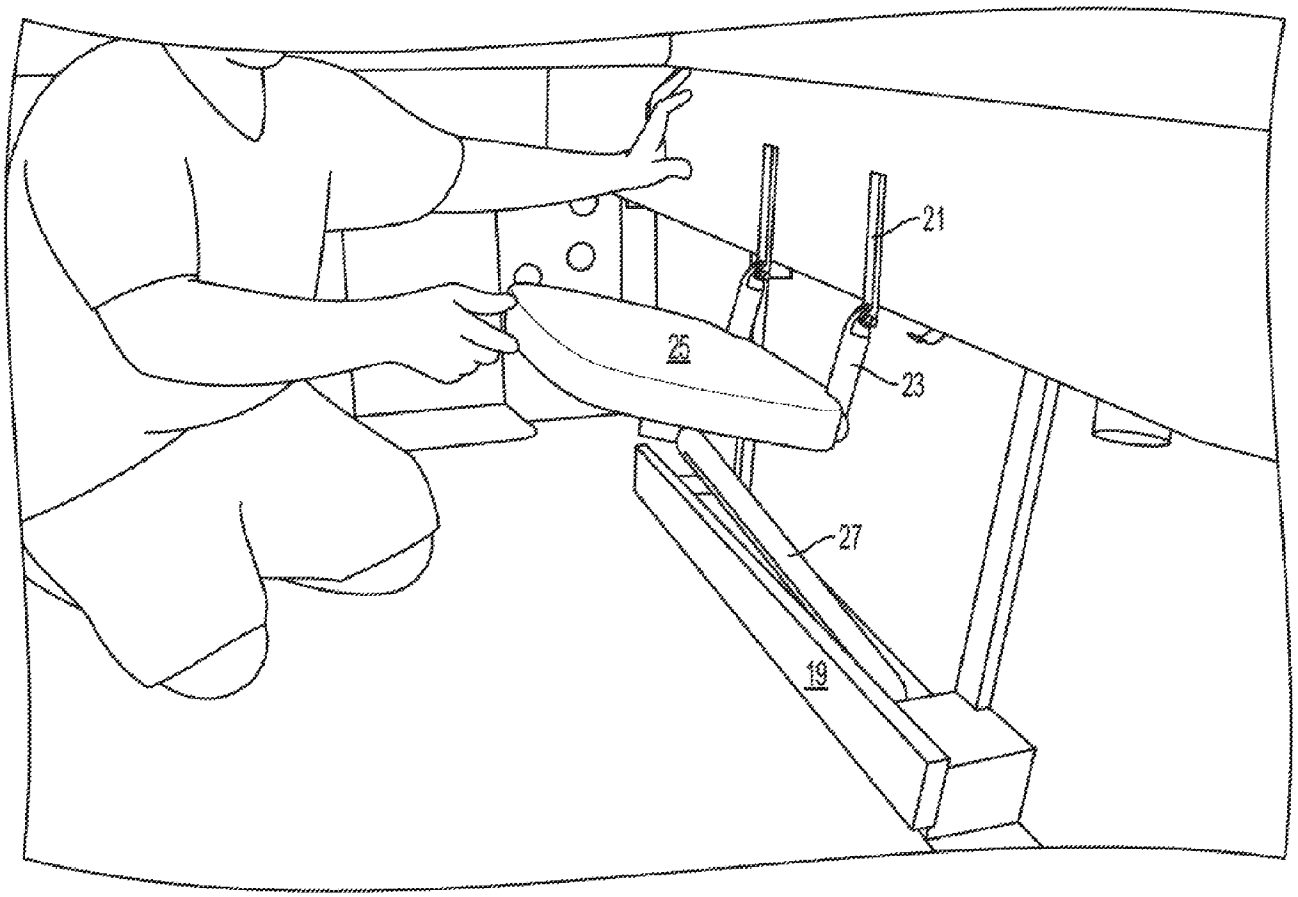
FIG. 12 is a perspective view as in FIGS. 8-11 showing the step in a fourth position being lowered onto the support bar.
Figure 13:
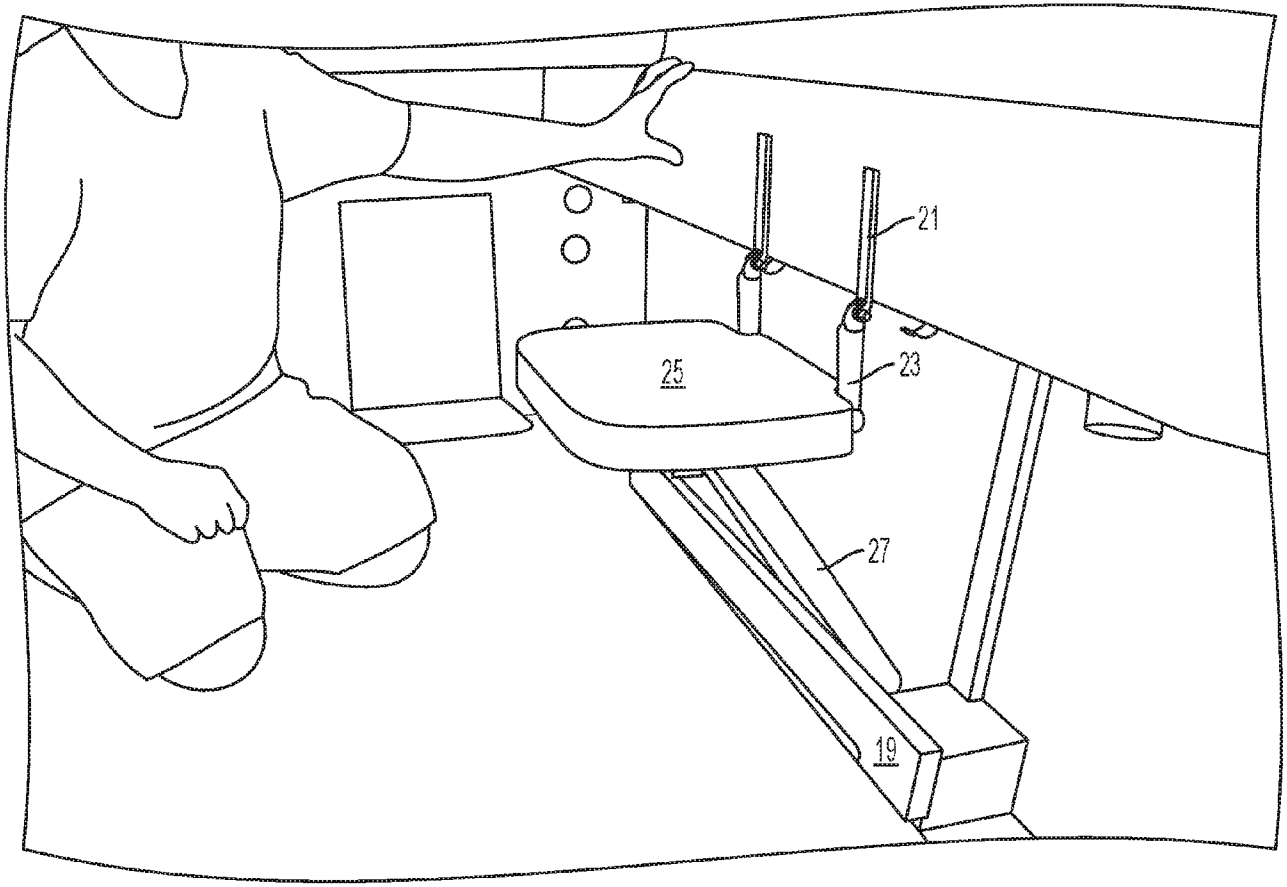
FIG. 13 is a perspective view as in FIGS. 8-12 showing the step supported in a fully deployed position.

IAs will be appreciated, the support bar 27 initially rests against the toe rail 19 as shown in FIG. 11 and then the step 25 is allowed to pivot downward to be braced against the abutment flange 29 to support step 25, and thereby relieve the load on the toe rail 19, as is shown in FIGS. 12 and 13. In this position the support bar 27 no longer rests on the toe rail 19.

Figure 14:
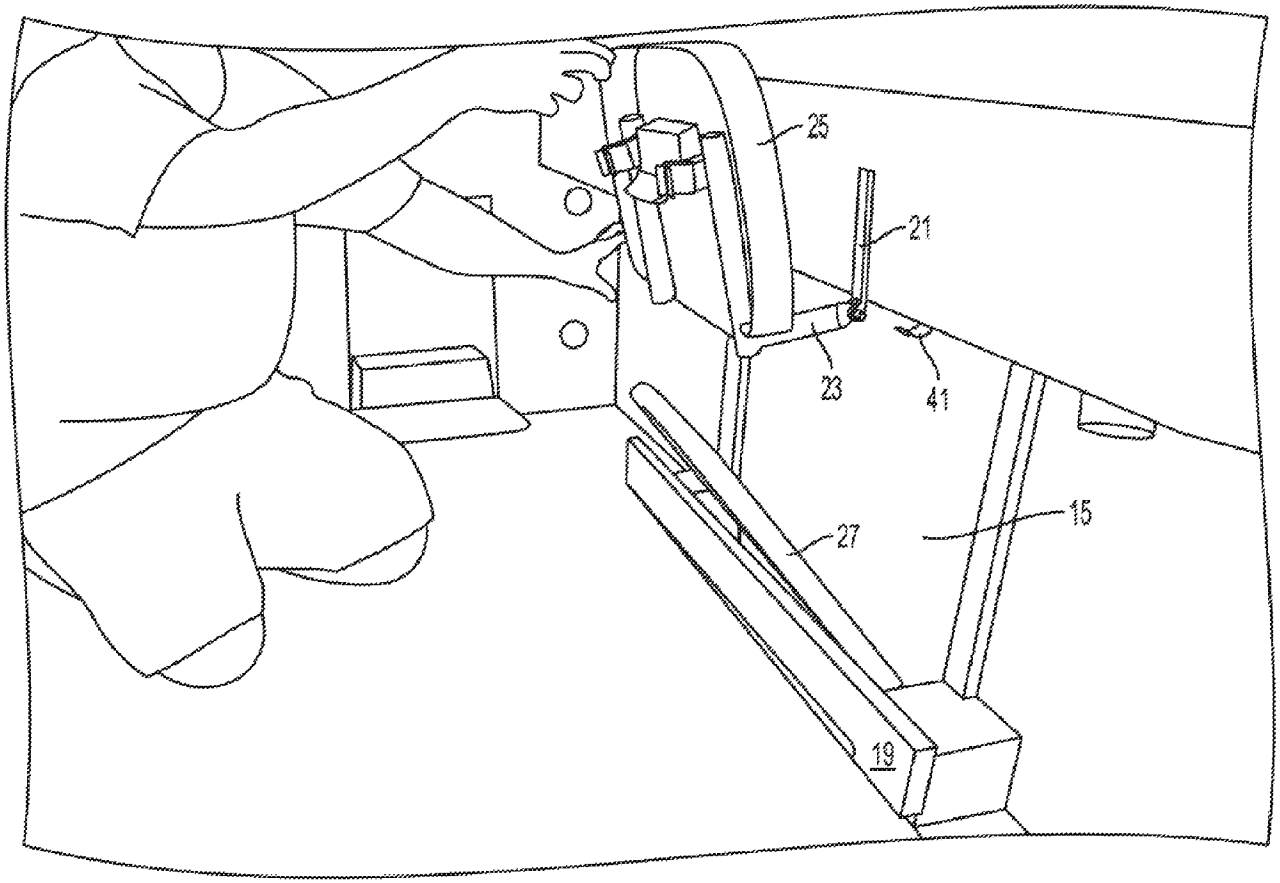
FIG. 14 is a perspective view as in FIGS. 8-13 showing the step at an upward location showing movement from a deployed position into a position to allow stowing.
Figure 15:
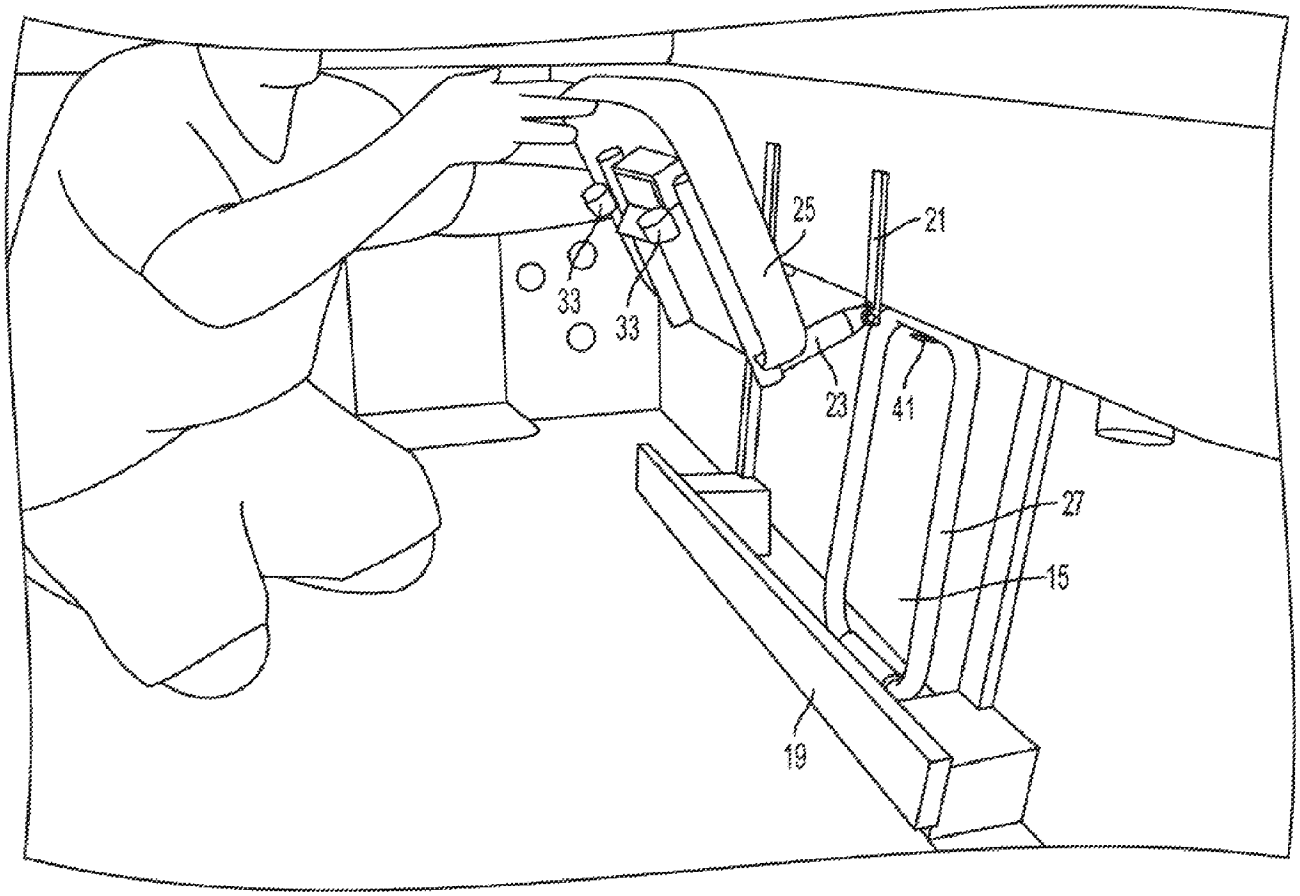
FIG. 15 is a perspective view as in FIGS. 8-14 showing the support bar moved into a stowed position to allow the step to be lowered into stowed position.
Figure 16:
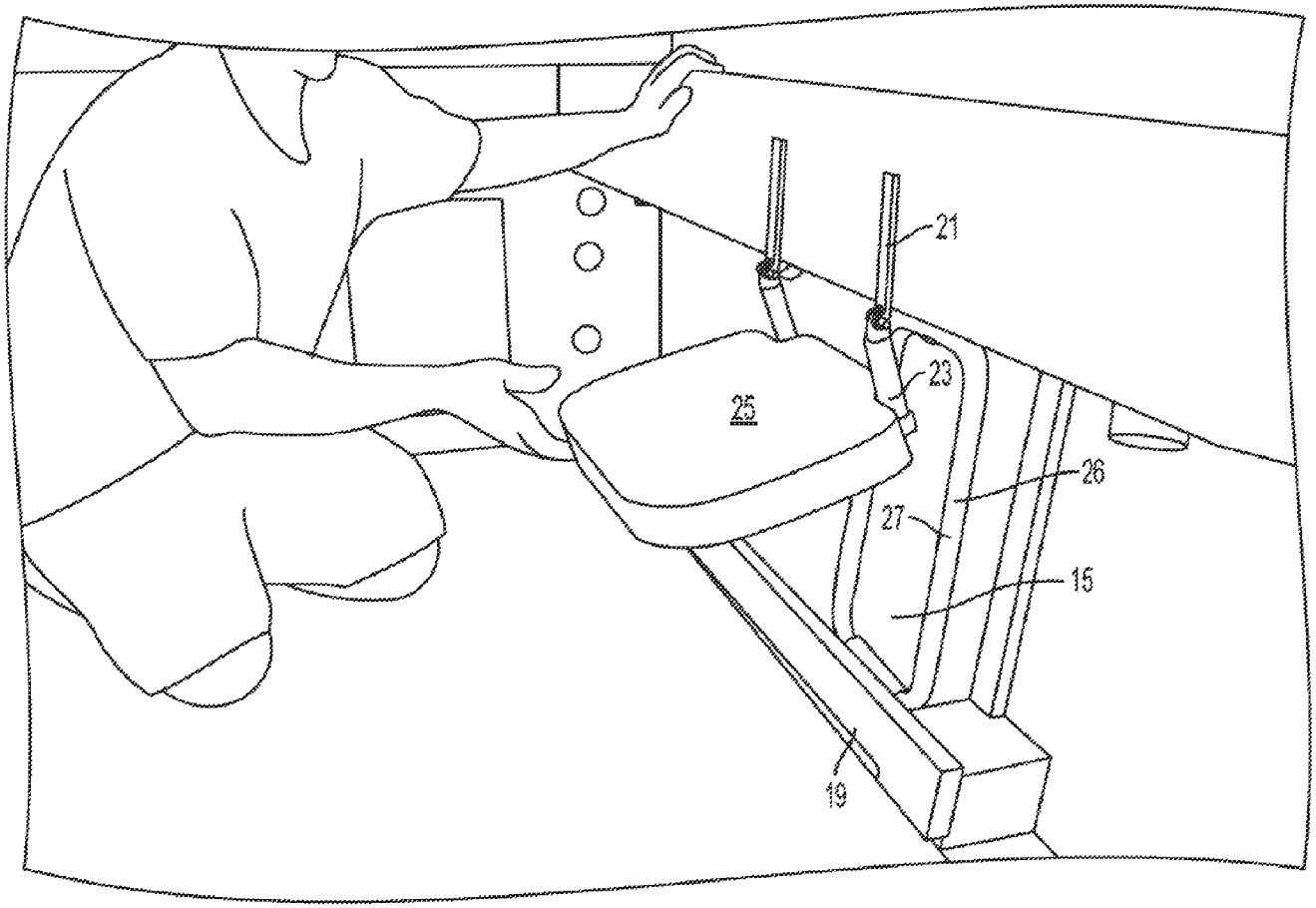
FIG. 16 is a perspective view as in FIGS. 8-15 showing the step lowered into an intermediate position before being moved into a fully stowed position.

In order to stow the step 25, as shown in FIG. 14, the step 25 need merely be lifted upwardly away from the support bar 27. The support bar 27 is then pivoted back into the stowage area 15 to be secured by support bar clip 41 as shown in FIG. 15. FIG. 16 shows that the step 25 is then allowed to pivot back into the stowage area 15 to be clipped against the vertically extending portions 26 of support bar 27.

Figure 17:
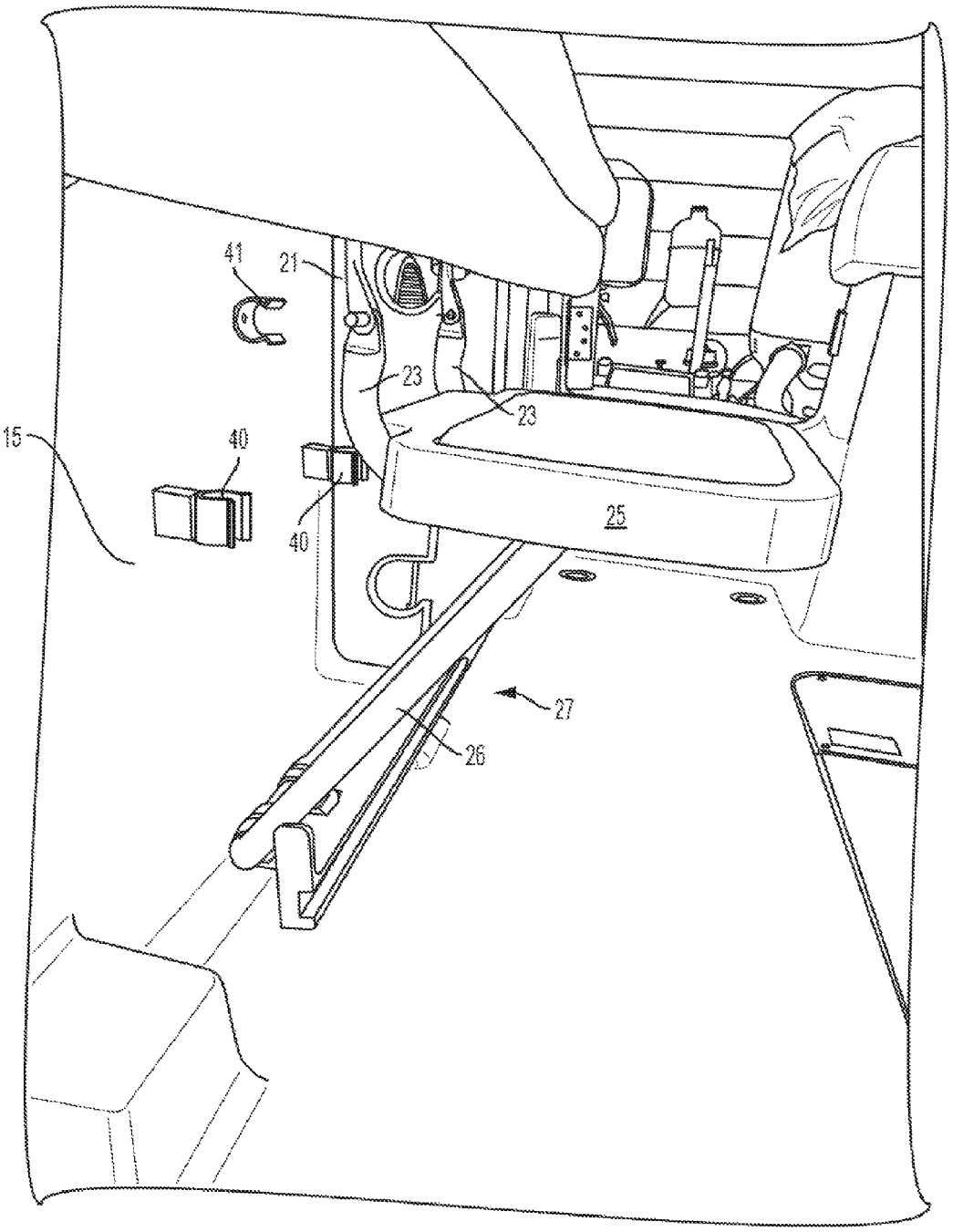
FIG. 17 is a perspective view from the side of another embodiment of the step of the invention shown deployed.
Figure 18:
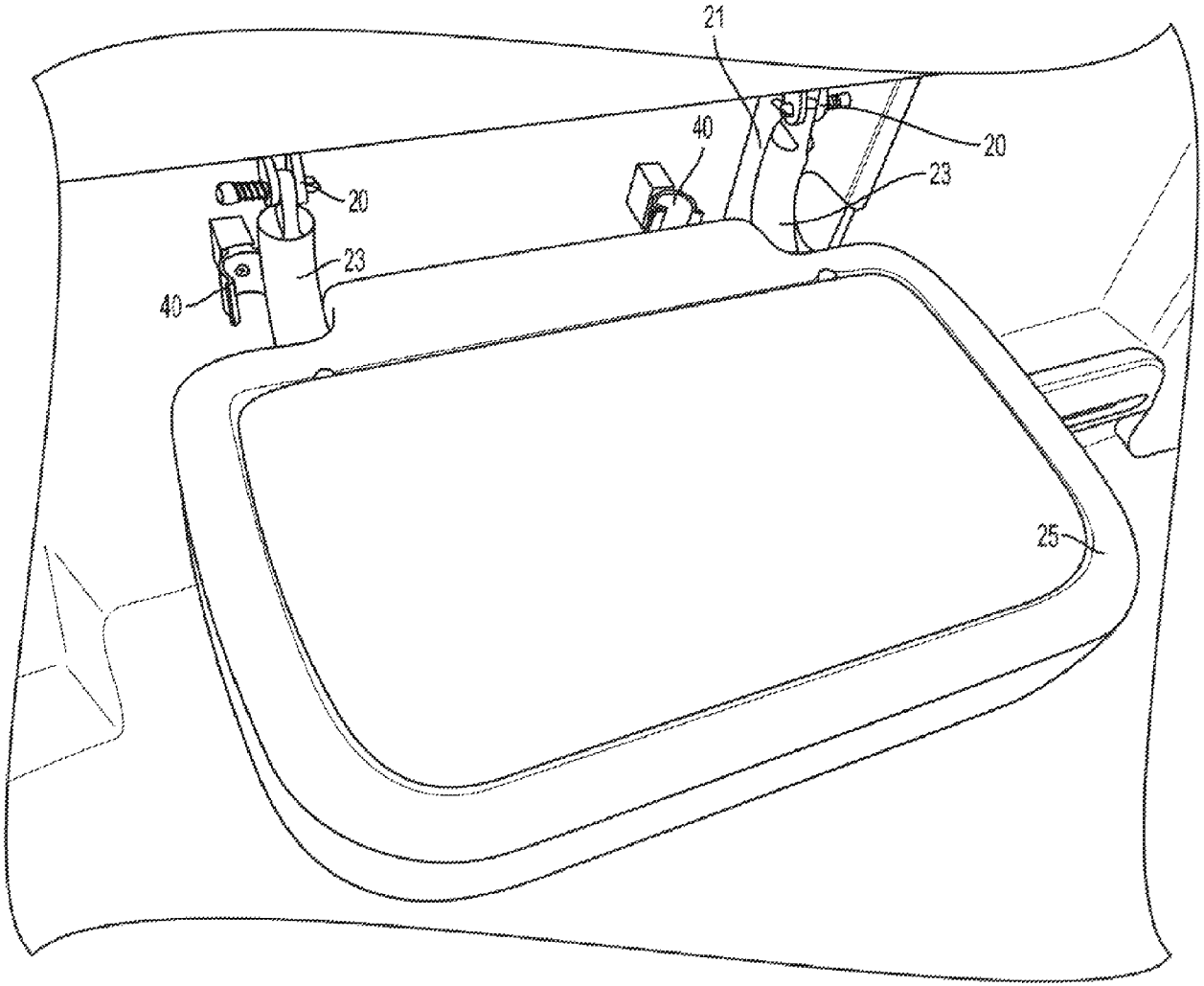
FIG. 18 is a perspective view from the top of part of the step of the embodiment of FIG. 17 shown in deployed position.

FIGS. 17-20 illustrate in greater detail other aspects of an embodiment of the invention. More specifically, FIG. 17 illustrates an embodiment of the stowable folding step of the invention in which additional support bar clips 40 are mounted on a wall of the stowage area 15 as shown therein. These support bar clips 40 provide an additional securing mechanism, and serve to clip onto the vertically extending portions 26 of the support bar 27 when stowed. Also illustrated in FIG. 17 is the generally curved transition of the step support brackets 23, which are pivotally connected to the gunwale brackets 21. This curved section of the step support brackets 23 is further illustrated in detail in FIG. 18 in which a pivoting connection 20 for the step support brackets 23 and gunwale brackets 21 is shown.

Figure 19:
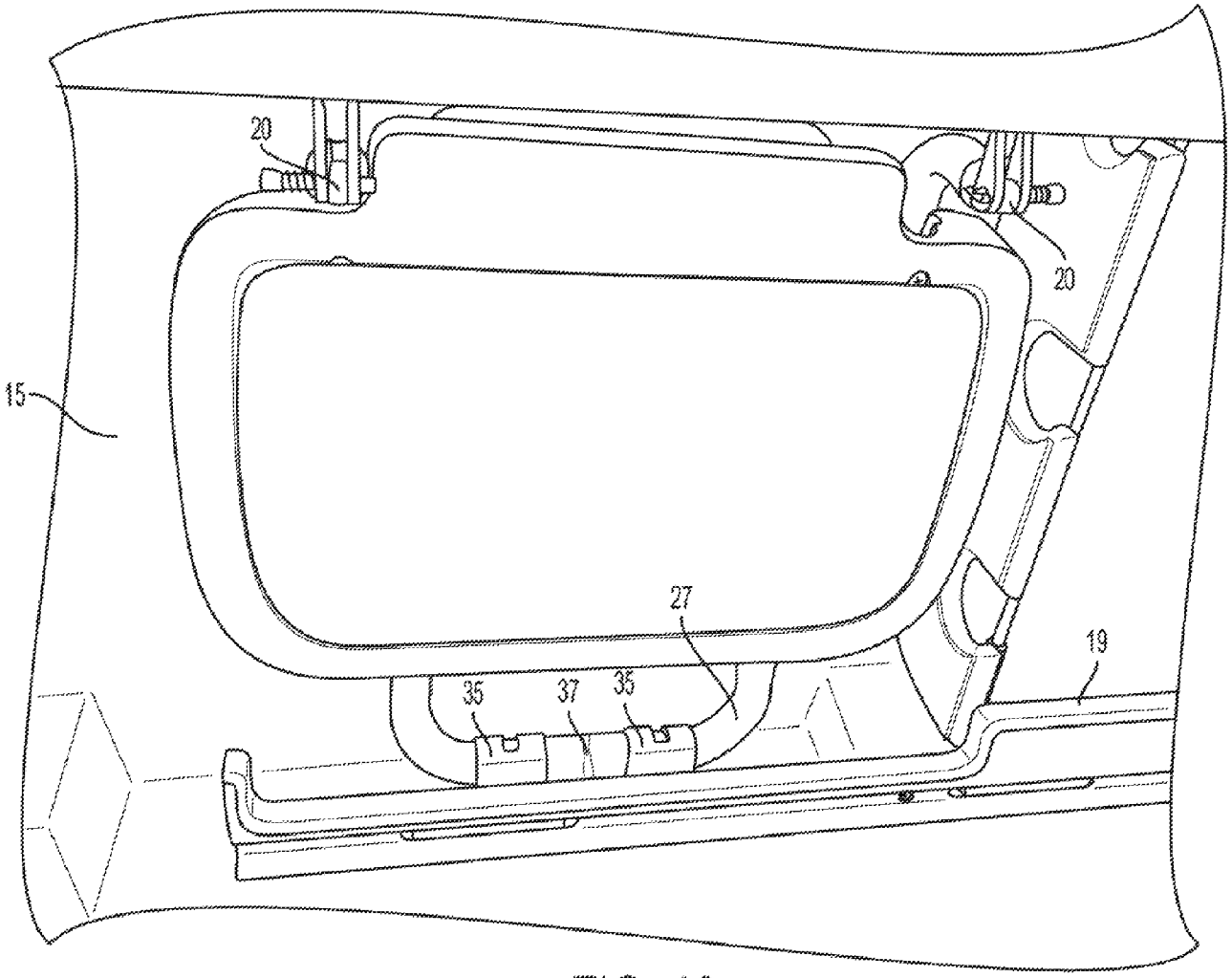
FIG. 19 is a perspective front view of the embodiment of FIG. 17 with the step shown in stowed position.
Figure 20:
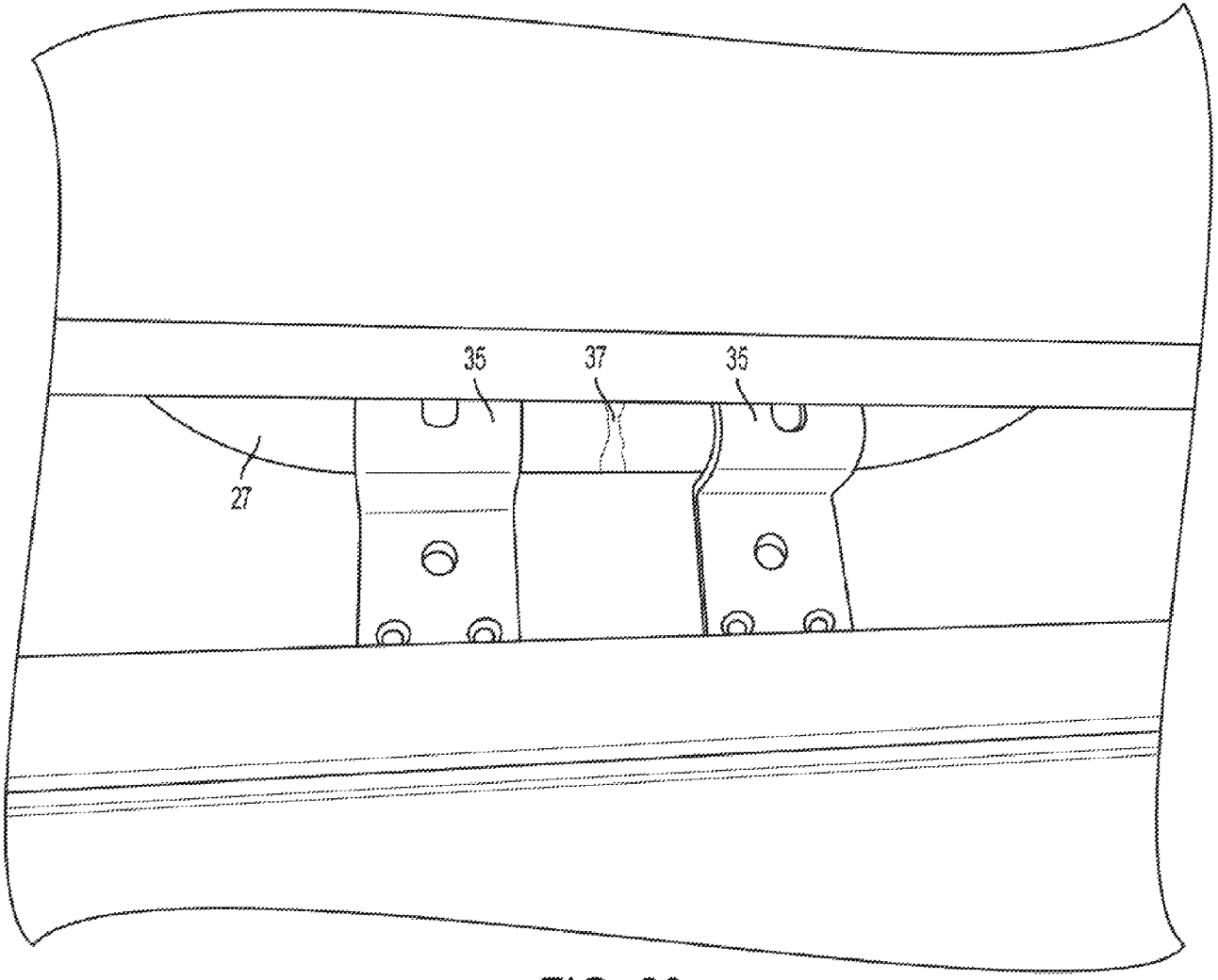
FIG. 20 is an enlarged view of the support bar and support bar clips holding the support bar within the stowage area.

FIG. 19 illustrates in partial view the seat in accordance with the invention shown in stowed position. Greater details about the horizontal portion 37 of the support bar 27 and the mounting clips 35 retaining the support bar 27 at the bottom within the stowage area in pivoting engagement are more clearly shown in FIGS. 19 and 20.

Thus, in accordance with the invention there is provided an innovative and easily used step and system. In addition to being used as a step, as will be appreciated, the step could also be used as a seat with comfort support being provided for a user's back by the bolster 13.

Although the invention has been shown and described with reference to certain illustrative embodiments, those skilled in the art will undoubtedly find alternative embodiments obvious after the reading of this disclosure. With this in mind, the following claims are intended to define the scope of protection to be afforded and those claims are deemed to include equivalent constructions insofar as they do not depart from the spirit and scope of the present invention.

What is claimed is:

1. A folding step system for a boat, comprising:

at least one gunwale bracket connectable to a wall which extends downward from a gunwale of a boat when connected within a boat cockpit;

at least one step support bracket connected to the at least one gunwale bracket, in pivoting relationship thereto, for supporting a step in a deployed position and in a stowed position when connected within the boat;

the step mounted on the at least one step support bracket, said step having an upper step surface; and a support bar pivotally mountable in a stowage area of the boat cockpit for pivoting in an outward direction for bracing and supporting the step in the deployed position, and for pivoting into a vertical position to allow the step to pivot into a vertically extending position for being stowed in the stowage area of the boat cockpit.

2. The folding step system of claim 1, further comprising:

mounting clips for retaining the support bar at a bottom section thereof in a pivoting manner within the stowage area.

3. The folding step system of claim 1, further comprising:

a support bar clip securable to a wall within the stowage area at a location for engaging and retaining the support bar is in a stowed position.

4. The folding step system of claim 3, wherein the support bar is generally o-shaped having two vertically extending sections parallel to each other, and two horizontally extending sections parallel to each other.

5. The folding step system of claim 4, further comprising:

at least one step clip located on a lower surface of the step at a location for attaching the step to the support bar when the step is in the stowed position.

6. The folding step system of claim 1, wherein said at least one step support bracket comprises:

two step support brackets.

7. The folding step system of claim 5, wherein said at least one step clip comprises:

two step clips for being secured to corresponding ones of said two horizontally extending sections of the support bar for securing the step within the stowage area.

8. The folding step system of claim 1, wherein said step further comprises:

an abutment flange on the bottom thereof for having said support bar engage the abutment flange to support and support said step when said step is in the deployed position.

9. The folding step system of claim 4, wherein said support bar clip comprises:

three support bar clips for engaging respectively with said two vertically extending sections of the support bar and for engaging with a horizontally extending upper section of the support bar for retaining the step in the stowed position.

10. A folding step system for a boat comprising;

a pair of gunwale brackets connectable to a wall extending downward from a gunwale of a boat when connected within a boat cockpit;

a pair of support brackets, each connected respectively to corresponding ones of the pair of gunwale brackets in pivoting relationship thereto for supporting a step in a deployed position, and in a stowed position when connected within the boat;

the step mounted on the pair of supporting brackets, said step having an upper surface;

a support bar pivotally mountable in a stowage area of a boat cockpit for pivoting in an outward direction for bracing the step in the deployed position, and for pivoting into a vertical position to allow the step to pivot into a vertically extending position for being stowed in the stowage area of the boat cockpit;

the step having a bottom surface with an abutment flange extending from the bottom surface for having said support bar engage therewith to support said step when said step is in the deployed position;

at least one support bar clip mounted on a wall of the boat cockpit for retaining the support bar in the stowed position, and at least one step clip extending from the bottom surface of the step for securing the step to the support bar when in the stowed position.

11. In a boat cockpit having a stowage area, a folding step system, comprising:

at least one gunwale bracket connectable to a wall extending downward from a gunwale of a boat when connected within a boat cockpit;

at least one step support bracket connectable to the at least one gunwale bracket, in pivoting relationship thereto, for supporting a step in a deployed position and in a stowed position when connected within the boat; and the step mounted on the at least one step support bracket, said step having an upper step surface; and a support bar pivotally mountable in a stowage area of the boat cockpit for pivoting in an outward direction for bracing and supporting the step in the deployed position and for pivoting into a vertical position to allow the step to pivot into a vertically extending position for being stowed in the stowage area of the boat cockpit.

12. The folding step system of claim 11, further comprising:

mounting clips for retaining the support bar at a bottom section thereof in a pivoting manner within the stowage area.

13. The folding step system of claim 11, further comprising:

a support bar clip securable to a wall within the stowage area at a location for engaging and retaining the support bar is in a stowed position.

14. The folding step system of claim 13, wherein the support bar is generally o-shaped having two vertically extending sections parallel to each other, and two horizontally extending sections parallel to each other.

15. The folding step system of claim 14, further comprising:

at least one step clip located on a lower surface of the step at a location for attaching the step to the support bar when the step is in the stowed position.

16. The folding step system of claim 11, wherein said at least one step support bracket comprises:

two step support brackets.

17. The folding step system of claim 15, wherein said at least one step clip comprises:

two step clips for being secured to corresponding ones of said two horizontally extending sections of the support bar for securing the step within the stowage area.

18. The folding step system of claim 11, wherein said step further comprises:

an abutment flange on the bottom thereof for having said support bar engage the abutment flange to support and secure said step when said step is in the deployed position.

19. The folding step system of claim 14, wherein said support bar clip comprises:

three support bar clips for engaging respectively with said two vertically extending sections of the support bar and for engaging with a horizontally extending upper section of the support bar for retaining the step in the stowed position.

* * * * *